US011692356B2

(12) United States Patent
Xu

(10) Patent No.: US 11,692,356 B2
(45) Date of Patent: Jul. 4, 2023

(54) FULLY-ASSEMBLED STAIRCASE SYSTEM AND ASSEMBLY METHOD

(71) Applicant: Changzhou Vocational Institute of Engineering, Jiangsu (CN)

(72) Inventor: Xiaoming Xu, Jiangsu (CN)

(73) Assignee: CHANGZHOU VOCATIONAL INSTITUTE OF ENGINEERING, Jiangsu (CN)

( * ) Notice: Subject to any disclaimer, the term of this patent is extended or adjusted under 35 U.S.C. 154(b) by 0 days.

(21) Appl. No.: 17/621,423

(22) PCT Filed: May 26, 2020

(86) PCT No.: PCT/CN2020/092214
§ 371 (c)(1),
(2) Date: Dec. 21, 2021

(87) PCT Pub. No.: WO2021/184540
PCT Pub. Date: Sep. 23, 2021

(65) Prior Publication Data

US 2022/0259864 A1 Aug. 18, 2022

(30) Foreign Application Priority Data

Mar. 18, 2020 (CN) ..... 202010189586.6

(51) Int. Cl.
*E04F 11/035* (2006.01)
*E04F 11/09* (2006.01)
(Continued)

(52) U.S. Cl.
CPC ..... *E04F 11/035* (2013.01); *E04F 11/09* (2013.01); *E04F 11/116* (2013.01);
(Continued)

(58) Field of Classification Search
CPC ..... E04F 2011/1821; E04F 2011/1889; E04F 2011/1819; E04F 2011/1868;
(Continued)

(56) References Cited

U.S. PATENT DOCUMENTS 1,075,156 A * 10/1913 Nesdall ..... E04F 11/025 52/191
2,885,883 A * 5/1959 Decio ..... E04F 11/022 52/189
(Continued)

FOREIGN PATENT DOCUMENTS

CN 201217898 Y 4/2009
CN 104631719 A 5/2015
(Continued)

*Primary Examiner* — Jessica L Laux
(74) *Attorney, Agent, or Firm* — Muncy, Geissler, Olds & Lowe, P.C.

(57) ABSTRACT

The present invention discloses a fully-assembled staircase system and an assembly method. The fully-assembled staircase system includes a stair slab, stair steps, stair stringers, landing slabs, steel connectors, and a stair handrail, where a main body of the stair slab is an inclined flat plate structure, lap joints are disposed at an upper end and a lower end of the stair slab LTB, an outer edge of an upper surface of the lap joint is provided with first grooves, one side of the landing slab PB is provided with second grooves, the stair stringer is an inverted T-shaped structure, a top surface of a web of the stair stringer is provided with third grooves, two flanges of the stair stringer are respectively fixedly lapped with the stair slab and the landing slab, the first groove, the third groove, and the second groove after the lapping jointly form a steel-connector groove.

7 Claims, 7 Drawing Sheets

(51) Int. Cl.
*E04F 11/18* (2006.01)
*E04F 11/02* (2006.01)
*E04F 11/116* (2006.01)

(52) U.S. Cl.
CPC ..... *E04F 11/1812* (2013.01); *E04F 11/1817* (2013.01); *E04F 2011/0212* (2013.01); *E04F 2011/1821* (2013.01); *E04F 2011/1889* (2013.01)

(58) Field of Classification Search
CPC ..... E04F 2011/021; E04F 2011/0212; E04F 2011/0203; E04F 11/18; E04F 11/181; E04F 11/1812; E04F 11/1817; E04F 11/02; E04F 11/022; E04F 11/035; E04F 11/09; E04F 11/116
See application file for complete search history.

(56) References Cited

U.S. PATENT DOCUMENTS 3,007,283 A * 11/1961 Holland ..... E04F 11/022 52/436
3,762,115 A * 10/1973 McCaul, III ..... E04H 1/005 52/79.14
4,244,154 A * 1/1981 Weaver ..... E04F 11/022 182/115
4,707,957 A * 11/1987 Shepherd ..... E04F 11/02 182/115
8,104,576 B2 * 1/2012 Schwoerer ..... E04G 5/10 182/120
9,856,653 B1 * 1/2018 Smith ..... E04F 11/035
10,876,296 B2 * 12/2020 Glassman ..... E04F 11/035
2022/0251848 A1 * 8/2022 Sweetnam ..... E04F 11/062

FOREIGN PATENT DOCUMENTS

| | | | |
|---|---|---|---|
| CN | 208105705 | U | 11/2016 |
| CN | 206346407 | U | 7/2017 |
| CN | 207048205 | U | 2/2018 |
| CN | 209637140 | U | 11/2019 |
| CN | 110700503 | A | 1/2020 |
| CN | 111255174 | A | 6/2020 |
| JP | H0626158 | A | 2/1994 |
| JP | 2004353250 | A | 12/2004 |
| WO | WO-02/100149 | A2 | 12/2002 |

* cited by examiner

FULLY-ASSEMBLED STAIRCASE SYSTEM AND ASSEMBLY METHOD

TECHNICAL FIELD

The present invention relates to an assembled staircase, and in particular, to a fully-assembled staircase system and an assembly method.

BACKGROUND

Compared with conventional cast-in-situ reinforced concrete buildings, prefabricated buildings have the advantages of high component quality and high construction efficiency because the components are prefabricated in factory and assembled/installed on site, and are the main trend of construction development in the future. As an indispensable and important component of a prefabricated building, an assembled staircase is generally fabricated in a factory by pouring concrete to integrally form stair slabs and steps above the stair slabs according to a staircase building method in conventional construction. Because the stair slabs and the steps of the integrally fabricated staircase are connected together, the weight of the entire staircase is increased, which places higher requirements on the load capacity of the machinery for lifting and conveying the staircase, and also increases the difficulty in on-site assembly of the staircase. Because the steps are integrally formed with the stair slabs, the upper surface of the staircase is uneven, and therefore, the fabricated stair components can only be horizontally placed individually on a site for maintenance and cannot be stacked together. As a result, more space is required for the maintenance of the stair components, which in turn affects the efficiency of the production of stair components as well as the economic benefits of the component factory. Staircases are important means for escape during occurrence of disasters such as earthquakes and fires. However, many component factories only consider the connection between stairs and stair stringers and the connection between landing slabs and stair stringers during the fabrication of assembled staircases but fail to fully consider the integrity of the stairs, the landing slabs, and the stair stringers as a whole, which greatly weakens the safety performance and the seismic performance of the staircases. In addition, many assembled staircase component manufacturers also fail to consider and configure the stair handrail as one of the components of the assembled staircase during production.

SUMMARY

To resolve the problems in the prior art, the present invention provides a fully-assembled staircase system and an assembly method.

The technical solution of the present invention is as follows:

The present invention provides a fully-assembled staircase system, including a stair slab LTB, stair steps, stair stringers TL, landing slabs PB, steel connectors GLJ, and a stair handrail, where a main body of the stair slab LTB is an inclined flat plate structure, lap joints are disposed at an upper end and a lower end of the stair slab LTB, an outer edge of an upper surface of the lap joint is provided with first grooves, one side of the landing slab PB is provided with second grooves, the stair stringer TL is an inverted T-shaped structure, a top surface of a web of the stair stringer TL is provided with third grooves, two flanges of the stair stringer TL are respectively fixedly lapped with the stair slab LTB and the landing slab PB, the first groove, the third groove, and the second groove after the lapping jointly form a steel-connector groove, and the steel connector GLJ is placed in and fixed to the steel-connector groove.

Further, an inner side of the lap joint at the upper end of the stair slab LTB is provided with engagement grooves configured to fix the last top step; an inner side of the lap joint at the lower end of the stair slab LTB upturns to form a sill configured to define the first step above the stair slab LTB, and protruding bayonets configured to fix the first step are disposed at the sill.

Further, the stair steps include standard stair steps TB and a top stair step TB1; the standard stair step TB includes a tread and a riser, front toes connected to a previous step and engagement grooves configured to fix the previous step are arranged at a front of the standard stair step TB close to a bottom, rear toes connected to a next step and bayonets configured to fix the next step are arranged at a rear of the standard stair step TB close to the bottom, and two side surfaces of the standard stair step TB are respectively provided with slots configured to install and fix stair handrail steel posts GLZ; and a structure of the top stair step TB1 is the same as a structure of the standard stair step TB except that no rear toe is disposed at a rear of the step in a composition of the top stair step TB1.

Further, the stair handrail includes stair handrail steel posts GLZ and stair handrail panels GLB; a stair-slab connecting portion fixedly connected to the stair slab is disposed on the stair handrail steel post GLZ, a rectangular tenon is disposed above the stair-slab connecting portion, the rectangular tenon is inserted into the slot on the side surface of the step, and a stair-handrail-panel connecting portion is disposed above the stair handrail steel post GLZ; and a plurality of stair-handrail-steel-post connecting portions are arranged on the stair handrail panel GLB in a length direction according to a spacing between the stair handrail steel posts GLZ, and the stair-handrail-panel connecting portions are connected to the stair-handrail-steel-post connecting portions in a one-to-one correspondence.

Further, each side of upper surfaces of the two flanges of the stair stringer TL is provided with pre-embedded bolt holes, a bolt hole is pre-embedded in the first groove of the stair slab LTB, a bolt hole is provided in the second groove of the landing slab PB, the steel connector GLJ is provided with two reserved bolt holes, one of the bolt holes is connected to the bolt hole in the first groove of the stair slab LTB and a bolt hole on one flange of the stair stringer TL and then fixed by using a fastening bolt, and the other bolt hole is connected to the bolt hole in the second groove of the landing slab PB and a bolt hole on the other flange of the stair stringer TL and then fixed by using a fastening bolt.

Further, each side surface of the stair slab LTB is provided with a bolt hole near the upper end and a bolt hole near the lower end for installing steel posts of the stair handrail, and a middle part of the side surface of the stair slab LTB is further provided with a plurality of bolt holes used for installing steel posts of the stair handrail and used as fixed points during lifting, conveying, and assembly of the stair slab.

The present invention further provides an assembly method for a fully-assembled staircase system, including:

1) installation of a stair slab LTB, stair stringers TL, and landing slabs PB: lifting and conveying the stair slab LTB, the stair stringer TL, and the landing slab PB to the same elevation, first placing steel connectors GLJ in first grooves, third grooves, and second grooves at joints between the three components, and then connecting and fixing the stair slab LTB, the stair stringer TL, and the landing slab PB by bolts and bolt holes;

2) installation of steps: installing the steps from bottom to top sequentially, where all the steps are standard stair steps TB except that the last step is a top stair step TB1; inserting a front toe on the first standard stair step into a sill at a lap joint at a lower end of the stair slab LTB, and inserting a protruding bayonet in the middle of the sill into an engagement groove at a bottom in the front of the step; and pressing, by using a front toe disposed at a bottom in the front of the second step, a rear toe disposed at a rear of the first step, inserting a bayonet disposed at the rear of the first step into an engagement groove provided in the front of the second step, and assembling other steps according to the same assembly method;

3) assembly of stair handrail steel posts GLZ: first inserting a rectangular tenon at a lower end of the steel post into a slot provided on a side surface of a step, and then fixedly connecting a stair-slab connecting portion under the rectangular tenon to a side surface of the stair slab to tightly connect the step, the stair slab, and the steel post; and 4) installation of stair handrail panels GLB: connecting stair-handrail-panel connecting portions of the handrail panel GLB to stair-handrail-steel-post connecting portions of the steel posts GLZ in a one-to-one correspondence; and connecting the stair slab LTB to the stair step by a fastener at a position at which the handrail is not disposed.

Beneficial effects of the present invention are as follows:

The present invention provides a design of a fully-assembled staircase system with a stair slab separated from steps. According to the characteristics of components of a staircase, the components are properly separated for factory prefabrication. The stair slab is completely separated from the steps, thereby greatly reducing the weight of a single component, lowering the requirement for the load capacity of the machinery used for lifting and conveying the component, and reducing the difficulty in hoisting construction. The designed stair slab is a flat plate. Therefore, on the one hand, the manufacturing difficulty of producing a steel formwork of the stair slab is reduced, and the manufacturing costs of the formwork are saved; on the other hand, because upper and lower surfaces of the stair slab are smooth, the stair slab can be stacked together for maintenance after pouring and demolding, which reduces the space required for maintenance, improves the utilization of the site and the production efficiency of the components, and greatly reduces production costs for a component factory. Specially provided structural means are incorporated into the design of the components to improve the integrity and the seismic performance of the staircase, so that the staircase becomes an important line of defense to protect life and safety during occurrence of a disaster. Therefore, the present invention has high engineering technology applicability and social and economic benefits.

Figure 1:
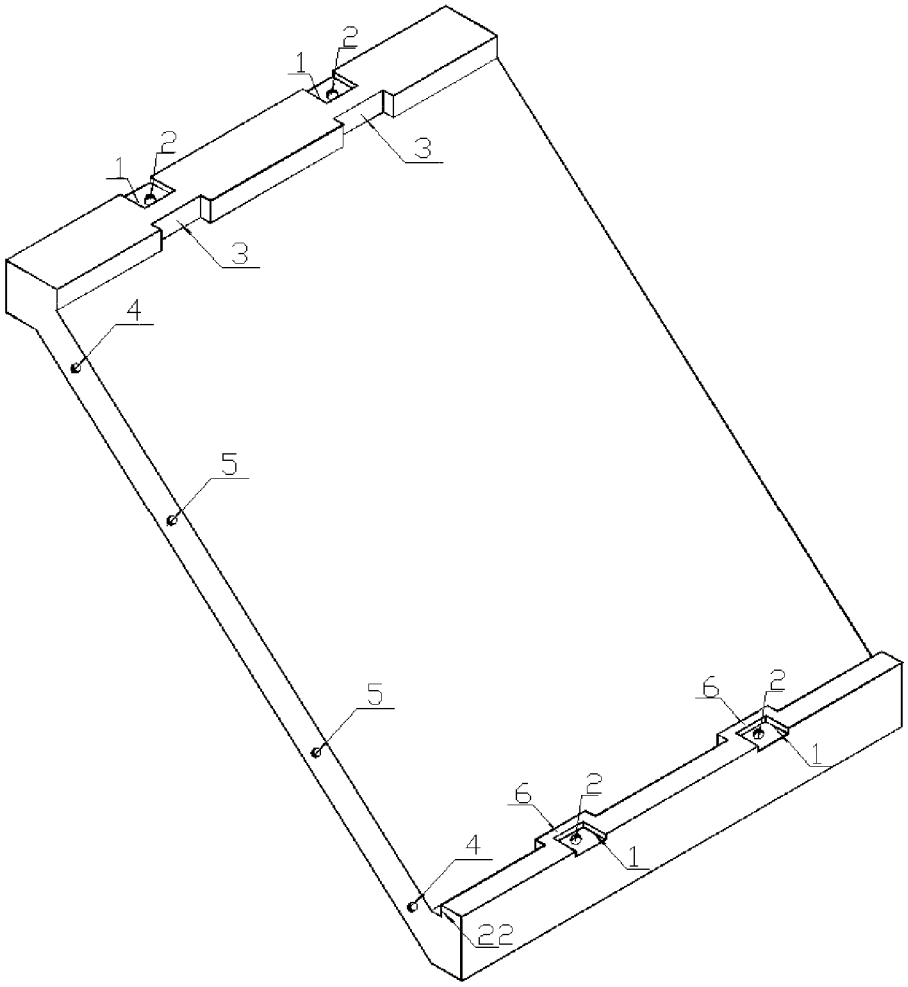
FIG. 1 is a schematic structural diagram of a stair slab LTB.

Reference Numerals: 1. first groove; 2. first pre-embedded bolt hole; 3. first engagement groove; 4. second pre-embedded bolt hole; 5. third pre-embedded bolt hole; 6. first bayonet; 7. front toe; 8. second engagement groove; 9. riser; 10. tread; 11. second bayonet; 12. rear toe; 13. second groove; 14. fourth pre-embedded bolt hole; 15. first bolt hole; 16. second bolt hole; 17. third bolt hole; 18. rectangular tenon; 19. fourth bolt hole; 20. slot; 21. fastening bolt; 22. sill; and 23. third groove.

DETAILED DESCRIPTION

The present invention will be further described in detail below with reference to the accompanying drawings.

A fully-assembled staircase system of the present invention includes prefabricated components such as a stair slab LTB, step units, stair stringers TL, landing slabs PB, a handrail GLB, and handrail steel posts GLZ. Upon full consideration of the integrity and the seismic performance that a staircase needs to meet, a series of specifically provided structural means and methods are adopted for on-site assembly of components of the staircase. The stair slab LTB (as shown in FIG. 1) is a reinforced concrete slab with smooth upper and lower surfaces prefabricated through a steel formwork in a prefabricated component factory.

Lap joints connected to the stair stringers are disposed at an upper end and a lower end of the slab. Each lap joint is provided with two first grooves 1 for placing and fixing steel connectors GLJ. The stair stringer and the landing slab PB are integrally connected by the steel connectors GLJ, thereby improving the integrity and the seismic performance of the staircase. A first pre-embedded bolt hole 2 is provided inside each groove to help connect the stair slab LTB to the stair stringer TL below reliably by bolts. The upper end of the stair slab LTB is provided with two first engagement grooves 3 for fixing the last step (top step). Each side surface of the stair slab LTB is provided with a second pre-embedded bolt hole 4 near the upper end and a second pre-embedded bolt hole 4 near the lower end, for installing steel posts GLZ of the stair handrail. A middle part of the side surface of the stair slab is further provided with two third pre-embedded bolt holes 5 having two functions: installing the steel posts of the stair handrail and being used as fixed points during lifting, conveying, and assembly of the stair slab LTB. A diameter and a depth of the second pre-embedded bolt hole 4 are the same as those of the third pre-embedded bolt hole 5. An inner side of the lap joint at the lower end of the stair slab LTB upturns to form a sill 22 configured to define the first step above the lower end of the stair slab LTB, and two protruding first bayonets (6) configured to fix a first standard step TB is disposed on the sill 22.

Figure 2:
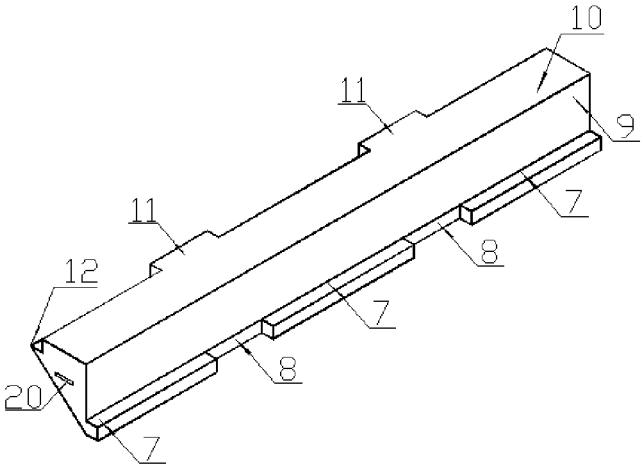
FIG. 2 is a schematic structural diagram of a standard stair step TB.
Figure 3:
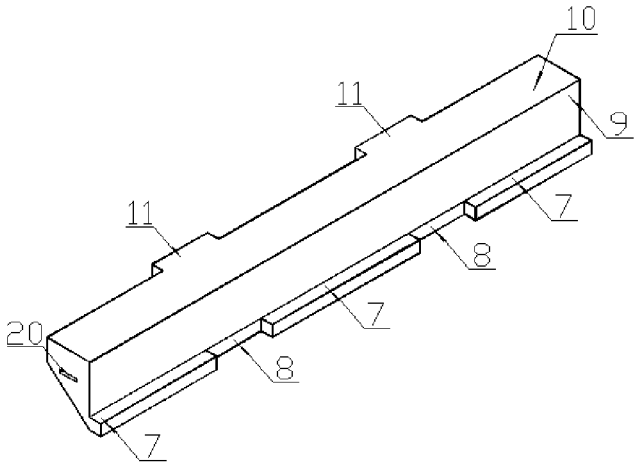
FIG. 3 is a schematic structural diagram of a top stair step TB1.

For the convenience of installation, the steps are designed into two types, namely standard steps TB (as shown in FIG. 2) and a top step TB1 (as shown in FIG. 3). The standard steps TB are used for the installation of steps other than the last step at the top, and the top step TB1 is installed as the last step for assembly. The standard step TB includes a tread 10 and a riser 9. Front toes (7) connected to a previous step and engagement grooves (8) configured to fix the previous step are arranged at a front of the step TB close to a bottom. Rear toes 12 connected to a next step and bayonets 11 configured to fix the next step are arranged at a rear of the step close to the bottom. Two side surfaces of the step are respectively provided with slots 20 configured to fix the stair handrail steel posts GLZ during installation of the stair handrail steel posts GLZ. The composition of the top step TB1 is the same as the composition of the standard step TB except that no rear toe is disposed at a rear of the top step TB1.

Figure 4:
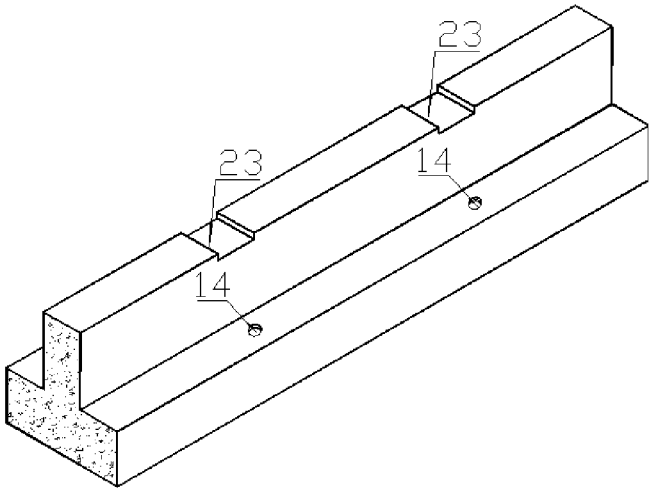
FIG. 4 is a schematic structural diagram of a stair stringer TL.

The stair stringer TL (as shown in FIG. 4) is designed as an inverted T-shaped stringer. Each side of upper surfaces of flanges of the stair stringer TL is provided with two fourth pre-embedded bolt holes 14 configured to fix and connect the stair slab LTB and the landing slab PB. A top surface of a web of the stair stringer TL is provided with two third grooves 23 for placing and fixing the steel connectors GLJ.

Figure 5:
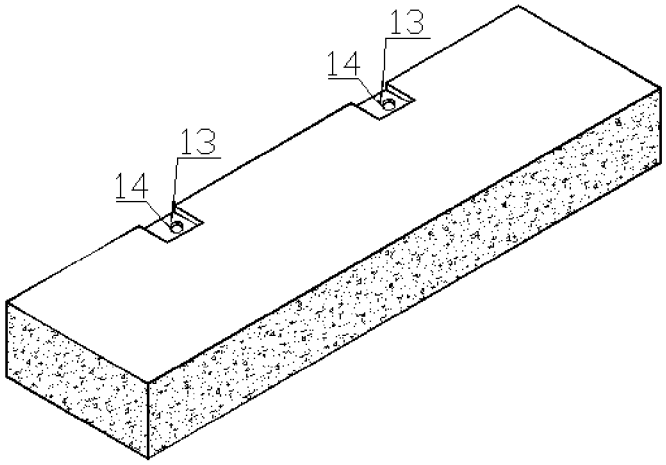
FIG. 5 is a schematic structural diagram of a landing slab PB.

A side of the landing slab PB (as shown in FIG. 5) connected and fixed to the stair stringer TL is provided with two second grooves 13 for placing and fixing the steel connectors GLJ. A fourth pre-embedded bolt hole 14 is provided in the second groove, and the landing slab PB is connected to the stair stringer TL by fastening bolts.

Figure 6:
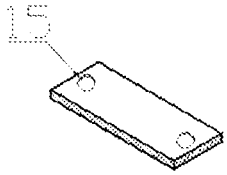
FIG. 6 is a schematic structural diagram of a steel connector GLJ configured to connect and fix a stair slab and a floor slab.

The steel connectors GLJ (as shown in FIG. 6) integrally connect the stair slab LTB, the stair stringer TL, and the landing slab PB by using reserved first bolt holes 15 and fastening bolts 21, to improve the integrity of the assembled staircase and enhance the seismic performance of the staircase.

Figure 7:
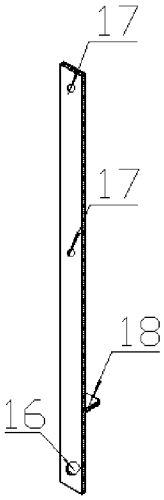
FIG. 7 is a schematic structural diagram of a stair handrail steel post GLZ.

The steel post GLZ (as shown in FIG. 7) is fixed to the side surface of the stair slab LTB by using a second bolt hole 16 provided at the bottom and a fastening bolt. A rectangular tenon 18 is welded above the second bolt hole 16. The rectangular tenon 18 is inserted into the slot 20 on the side surface of the step, thereby effectively preventing an installed step at an upper part of the stair slab from a lateral shift while enhancing the reliability of a connection between the steel post GLZ and the stair slab LTB. The steel post GLZ is fixed by using a bolt and the second bolt hole 16, and finally the steps, the stair slab, and the steel posts are integrally formed. Two third bolt holes 17 are provided at an upper part of the steel post GLZ for installing the stair handrail panel GLB.

Figure 8:
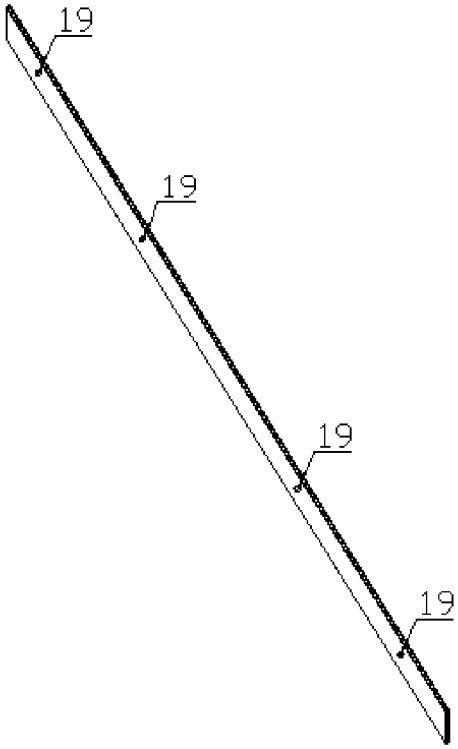
FIG. 8 is a schematic structural diagram of a stair handrail panel GLB.

The stair handrail panel GLB (as shown in FIG. 8) is provided with a row of fourth bolt holes 19 arranged in a length direction according to a spacing between the steel posts GLZ, and is assembled with the steel posts GLZ by using bolts.

Figure 9:
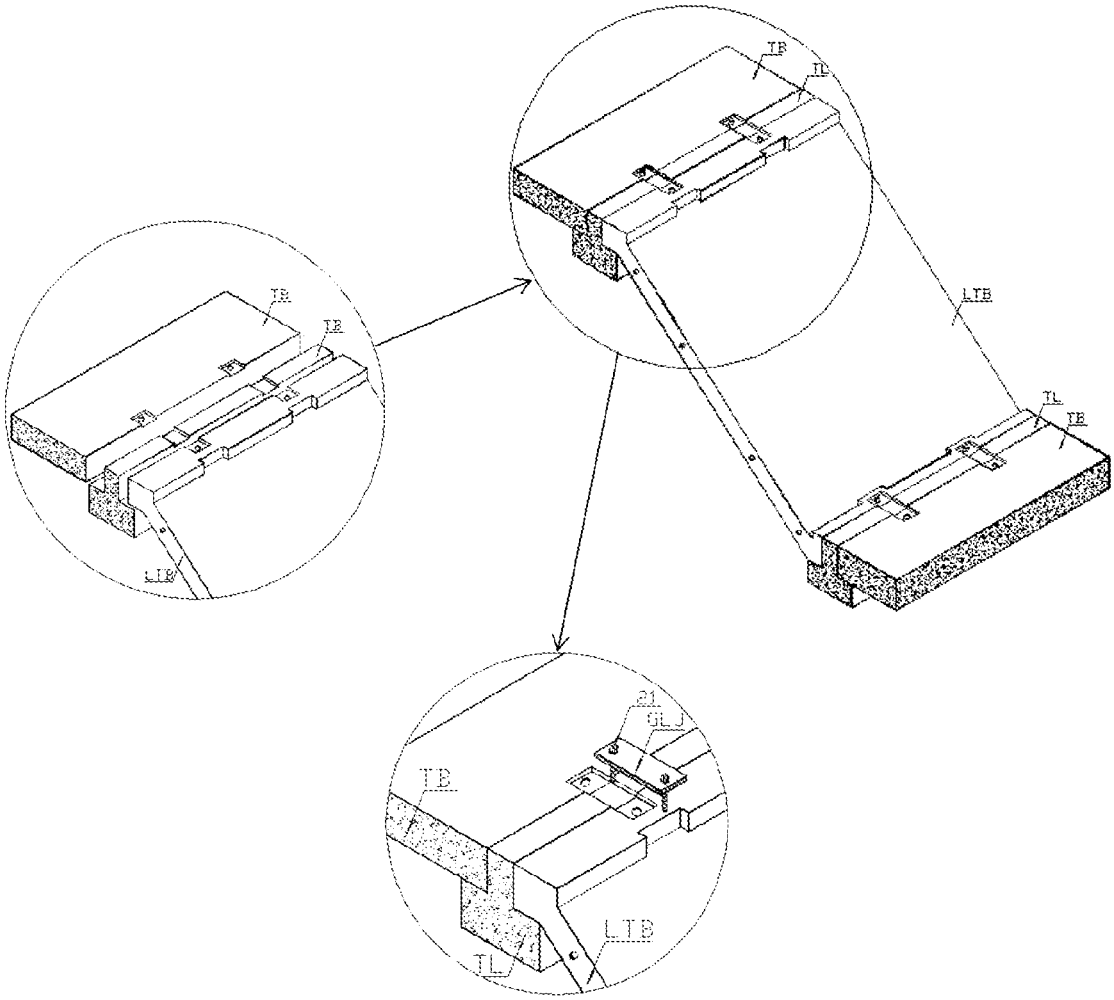
FIG. 9 is a schematic diagram of installing a stair slab, steps, and stair stringers.

A series of structural means are provided for each component in the composition of the staircase. Firstly, the stair stringers TL, the landing slab PB, and the stair slab LTB are fixedly connected by the steel connectors GLJ and the fastening bolts; then the standard steps TB are installed sequentially one by one from the first step below according to structural characteristics of the steps, and a top step TB1 is assembled as the last step; and the steel posts GLZ and the stair handrail panel GLB are installed after the installation of the steps is completed, and finally, the assembly of the entire staircase including the stair handrail is implemented. A specific assembly method and requirements are as follows:

1. Installation of a stair slab LTB, stair stringers TL, and landing slabs PB: The stair slab LTB, the stair stringer TL, and the landing slab PB are lifted and conveyed to the same elevation by using lifting machinery, steel connectors GLJ are first placed in first grooves 1, third grooves 23, and second grooves 13 at joints between the three components, and then fastening bolts are screwed into first pre-embedded bolt holes 2 and second pre-embedded bolt holes 4 to connect and fix the stair slab LTB, the stair stringer TL, and the landing slab PB (as shown in FIG. 9). The three components can be effectively integrally formed by using the steel connectors GLJ, thereby improving the seismic performance.

Figure 10:
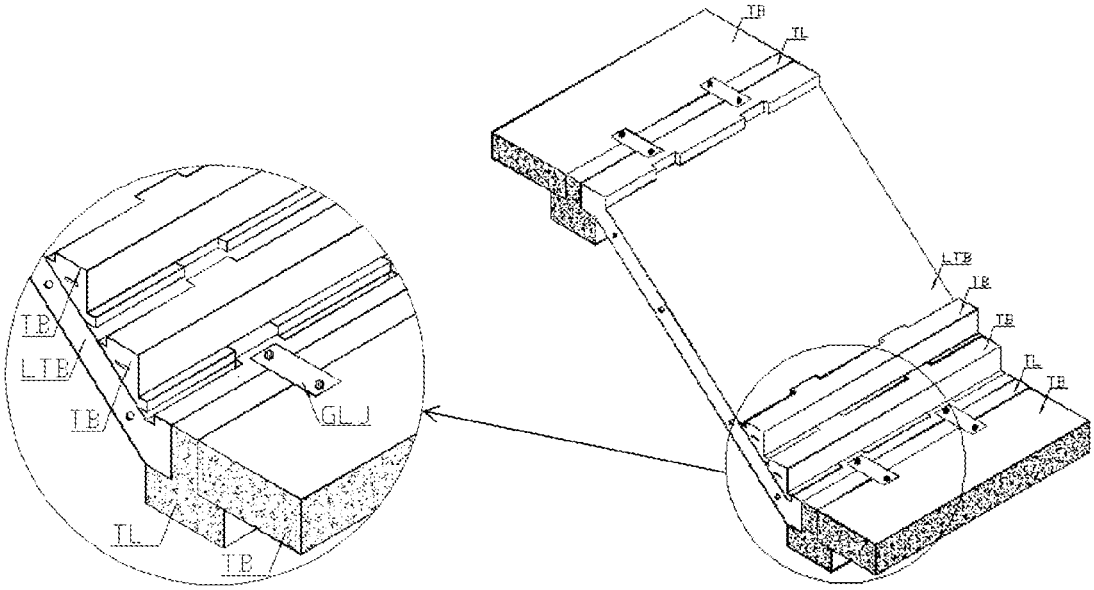
FIG. 10 is a schematic diagram of installing steps.
Figure 11:
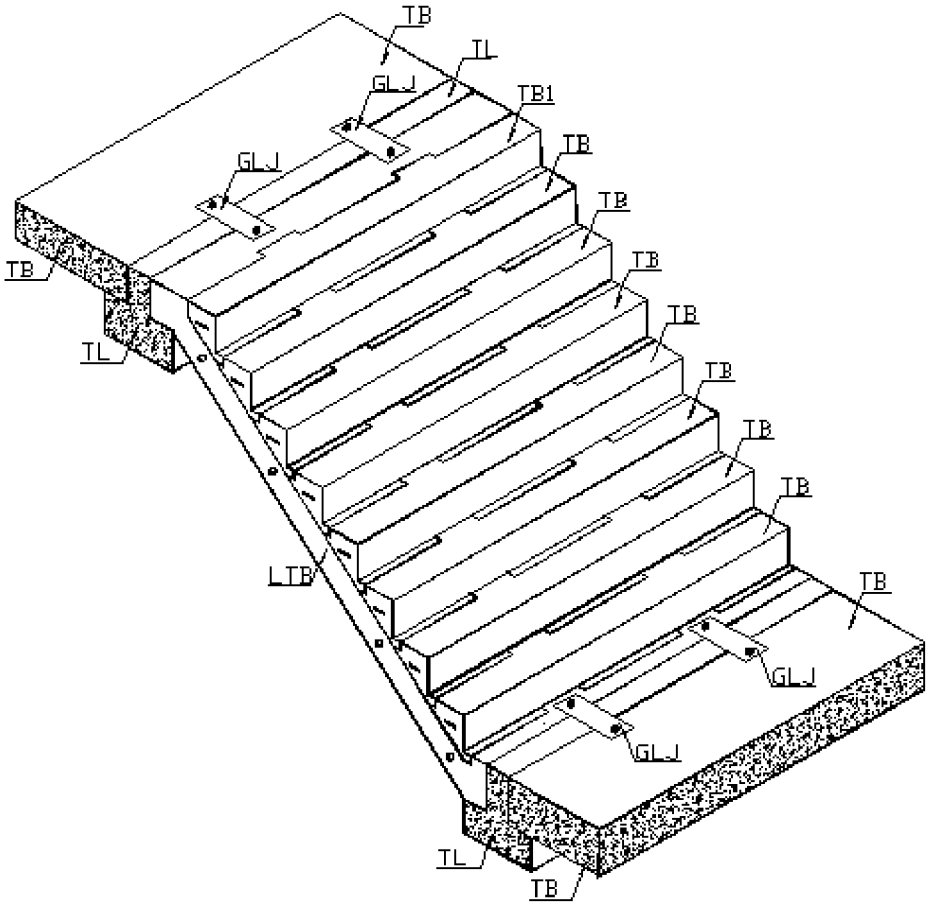
FIG. 11 is a schematic diagram of steps after installing is completed.

2. Installation of steps: Based on step 1, the steps are installed sequentially from bottom to top, all the steps are standard steps TB except that the last step is a top step TB1. During installation of the first standard step TB, it is necessary to ensure that front toes 7 at a bottom in the front of the step are inserted into a sill 22 at a lap joint at a lower end of the stair slab LTB, and ensure that two protruding first bayonets 6 disposed in the middle of the sill 22 are inserted into second engagement grooves 8 at the bottom in the front of the step. After the first step is assembled, rear toes 12 provided in the rear of the first step are pressed by using front toes 7 provided at the bottom in the front of the second step, and second bayonets 11 provided in the rear of the first step are inserted into second engagement grooves 8 provided in the front of the second step, thereby implementing the assembly and connection of two adjacent steps. Through tooth-like engagement of contact surfaces of adjacent components, a lateral displacement of the step can be effectively prevented. In addition, rear toes 12 of a previous step are pressed by a next step using front toes 7, thereby effectively preventing a longitudinal displacement of the next step (as shown in FIG. 10). The assembly method for other steps is the same as the above (as shown in FIG. 11).

Figure 12:
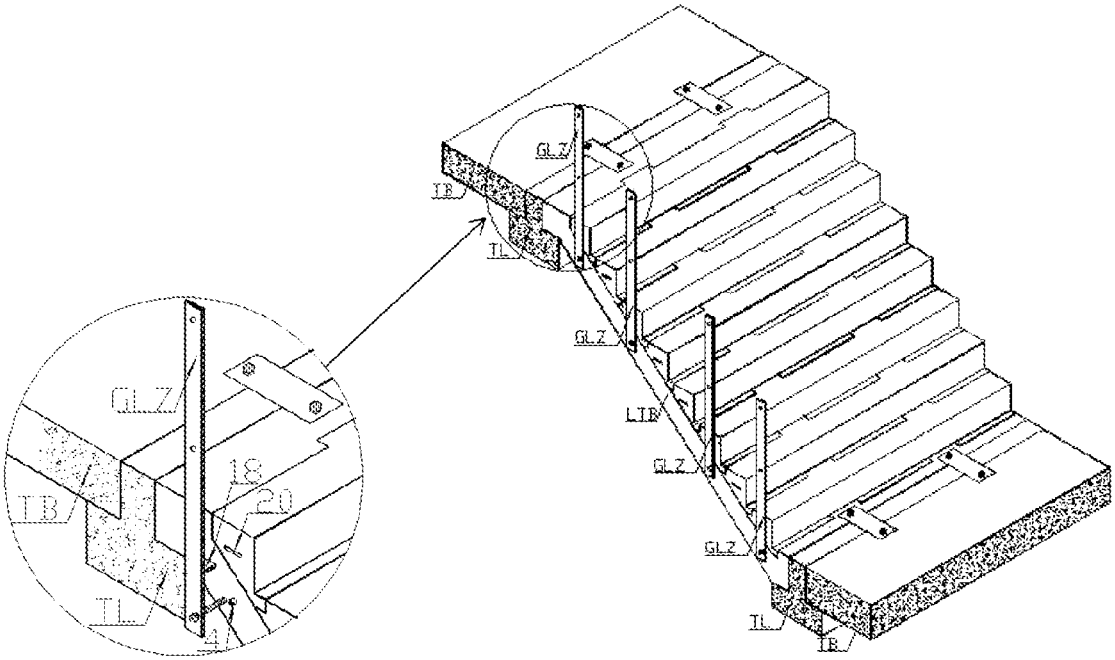
FIG. 12 is a schematic diagram of installing a stair handrail steel post.

3. Assembly of stair handrail steel posts GLZ: Based on step 2, during assembly of the steel post GLZ, a rectangular tenon 18 welded at a lower end of the steel post is first inserted into a slot 20 provided on a side surface of the step, and then a fastening bolt is screwed into a first pre-embedded bolt hole 4 or a third pre-embedded bolt hole 5 through a second bolt hole 16. According to the above two steps, the steel post GLZ is fixed to the stair slab, and the step, the stair slab, and the steel post can be tightly connected together. In addition, a lateral displacement of the step can also be prevented (as shown in FIG. 12).

Figure 13:
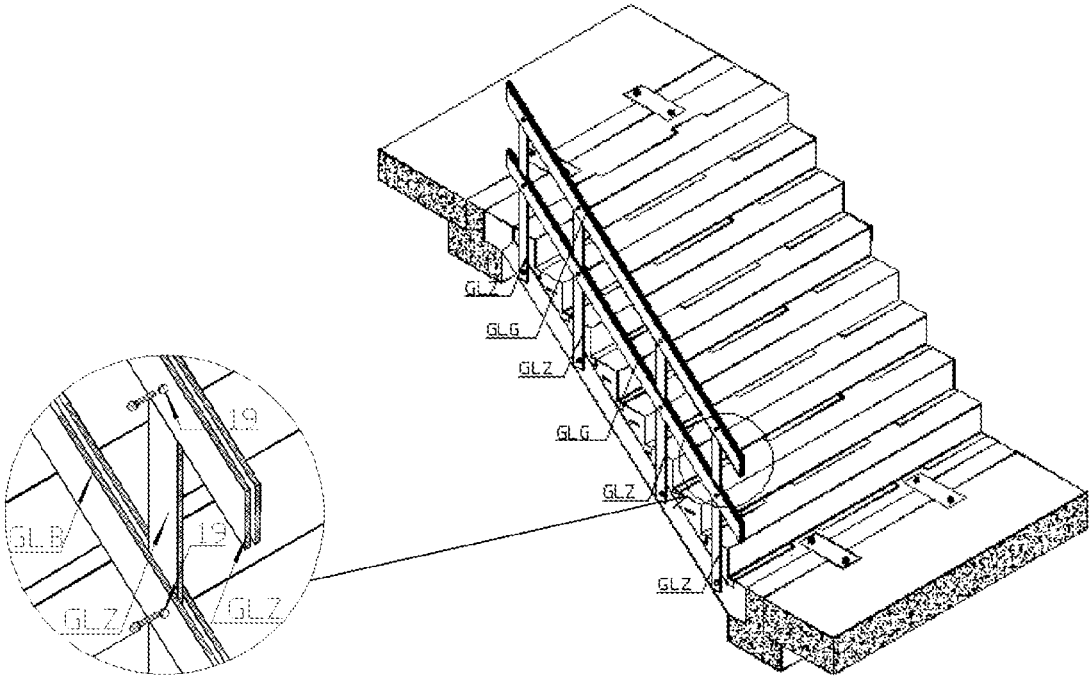
FIG. 13 is a schematic diagram of installing a stair steel handrail.

4. Installation of stair handrail panels GLB: Based on step 3, the handrail panel GLB and the steel posts GLZ are installed by using bolts passing through fourth bolt holes 19 provided on the stair handrail panel GLB and third bolt holes 17 provided on the steel posts GLZ. An upper handrail panel and a lower handrail panel need to be installed (as shown in FIG. 13).

Figure 14:
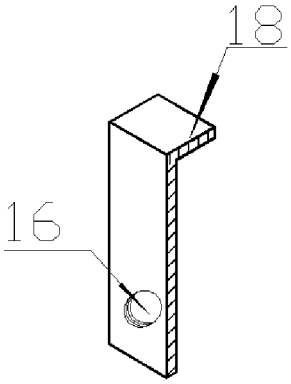
FIG. 14 is a schematic structural diagram of a steel connecting fastener GKJ.
Figure 15:
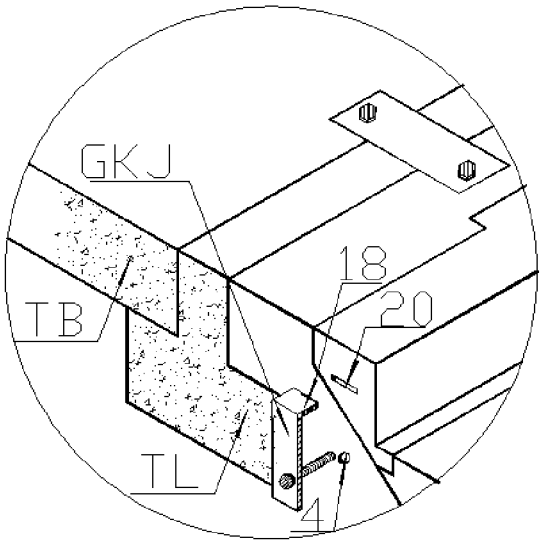
FIG. 15 is a schematic diagram of a connection between a step on which a handrail is not disposed and a stair slab.

If there is no handrail disposed on one side of a staircase, a steel fastener GKJ (as shown in FIG. 14) is used to connect the stair slab LTB and the step according to the installation method in step 3, to prevent a lateral displacement of the step (as shown in FIG. 15).

Based on the above, in the present invention, upon full consideration of the integrity and the seismic performance of the staircase, a series of specifically designed structural means are used to separate the stair slab from the steps. On the one hand, the weight of a single component is reduced, and the requirements for the load capacity of the lifting and conveying machinery and the difficulty in on-site assembly of the staircase are reduced; on the other hand, because the stair slab is a flat plate and can be stacked together for maintenance, the space occupied during the maintenance of stair components is reduced, and the production efficiency of the stair components is greatly improved. In addition, the stair handrail is integrated into a staircase assembly system for integrated assembly of components, thereby improving the efficiency of on-site construction and assembly while ensuring stability and safety.

The foregoing descriptions are merely preferred embodiments of the present invention and are not intended to limit the present invention. Any modification, equivalent replacement, or improvement made and the like within the spirit and principle of the present invention shall fall within the protection scope of the present invention.

What is claimed is:

1. A fully-assembled staircase system, comprising: a stair slab LTB, stair steps, stair stringers TL, landing slabs PB, steel connectors GLJ, and a stair handrail, wherein a main body of the stair slab LTB is an inclined flat plate structure, lap joints are disposed at an upper end and a lower end of the stair slab LTB, an outer edge of an upper surface of the lap joint is provided with first grooves (1), one side of the landing slab PB is provided with second grooves (13), the stair stringer TL is an inverted T-shaped structure, a top surface of a web of the stair stringer TL is provided with third grooves (23), two flanges of the stair stringer TL are respectively fixedly lapped with the stair slab LTB and the landing slab PB, the first groove (1), the third groove (23), and the second groove (13) after the lapping jointly form a steel-connector groove, and the steel connector GLJ is placed in and fixed to the steel-connector groove.

2. The fully-assembled staircase system according to claim 1, wherein an inner side of the lap joint at the upper end of the stair slab LTB is provided with engagement grooves (3) configured to fix the last top step; an inner side of the lap joint at the lower end of the stair slab LTB upturns to form a sill (22) configured to define the first step above the stair slab LTB, and protruding bayonets (6) configured to fix the first step are disposed at the sill (22).

3. The fully-assembled staircase system according to claim 1, wherein the stair steps comprise standard stair steps TB and a top stair step TB1; the standard stair step TB comprises a tread (10) and a riser (9), front toes (7) connected to a previous step and engagement grooves (8) configured to fix the previous step are arranged at a front of the standard stair step TB close to a bottom, rear toes (12) connected to a next step and bayonets (11) configured to fix the next step are arranged at a rear of the standard stair step TB close to the bottom, and two side surfaces of the standard stair step TB are respectively provided with slots (20) configured to install and fix stair handrail steel posts GLZ; and a structure of the top stair step TB1 is the same as a structure of the standard stair step TB except that no rear toe (12) is disposed at a rear of the step in a composition of the top stair step TB1.

4. The fully-assembled staircase system according to claim 3, wherein the stair handrail comprises stair handrail steel posts GLZ and stair handrail panels GLB; a stair-slab connecting portion fixedly connected to the stair slab is disposed on the stair handrail steel post GLZ, a rectangular tenon (18) is disposed above the stair-slab connecting portion, the rectangular tenon (18) is inserted into the slot (20) on the side surface of the step, and a stair-handrail-panel connecting portion is disposed above the stair handrail steel post GLZ; and a plurality of stair-handrail-steel-post connecting portions are arranged on the stair handrail panel GLB in a length direction according to a spacing between the stair handrail steel posts GLZ, and the stair-handrail-panel connecting portions are connected to the stair-handrail-steel-post connecting portions in a one-to-one correspondence.

5. The fully-assembled staircase system according to claim 1, wherein each side of upper surfaces of the two flanges of the stair stringer TL is provided with pre-embedded bolt holes, a bolt hole is pre-embedded in the first groove (1) of the stair slab LTB, a bolt hole is provided in the second groove (13) of the landing slab PB, the steel connector GLJ is provided with two reserved bolt holes, one of the bolt holes is connected to the bolt hole in the first groove (1) of the stair slab LTB and a bolt hole on one flange of the stair stringer TL and then fixed by using a fastening bolt, and the other bolt hole is connected to the bolt hole in the second groove (13) of the landing slab PB and a bolt hole on the other flange of the stair stringer TL and then fixed by using a fastening bolt.

6. The fully-assembled staircase system according to claim 1, wherein each side surface of the stair slab LTB is provided with a bolt hole near the upper end and a bolt hole near the lower end for installing steel posts of the stair handrail, and a middle part of the side surface of the stair slab LTB is further provided with a plurality of bolt holes used for installing steel posts of the stair handrail and used as fixed points during lifting, conveying, and assembly of the stair slab.

7. An assembly method for a fully-assembled staircase system, comprising:

1) installation of a stair slab LTB, stair stringers TL, and landing slabs PB: lifting and conveying the stair slab LTB, the stair stringer TL, and the landing slab PB to the same elevation, first placing steel connectors GLJ in first grooves (1), third grooves (23), and second grooves (13) at joints between the three components, and then connecting and fixing the stair slab LTB, the stair stringer TL, and the landing slab PB by bolts and bolt holes;

2) installation of steps: installing the steps from bottom to top sequentially, wherein all the steps are standard stair steps TB except that the last step is a top stair step TB1; inserting a front toe (7) on the first standard step into a sill (22) at a lap joint at a lower end of the stair slab LTB, and inserting a protruding bayonet (6) in the middle of the sill (22) into an engagement groove (8) at a bottom in the front of the step; and pressing, by using a front toe (7) disposed at a bottom in the front of the second step, a rear toe (12) disposed at a rear of the first step, inserting a bayonet (11) disposed at the rear of the first step into an engagement groove (8) provided in the front of the second step, and assembling other steps according to the same assembly method;

3) assembly of stair handrail steel posts GLZ: first inserting a rectangular tenon (18) at a lower end of the steel post into a slot (20) provided on a side surface of a step, and then fixedly connecting a stair-slab connecting portion under the rectangular tenon (18) to a side surface of the stair slab to tightly connect the step, the stair slab, and the steel post; and 4) installation of stair handrail panels GLB: connecting stair-handrail-panel connecting portions of the handrail panel GLB to stair-handrail-steel-post connecting portions of the steel posts GLZ in a one-to-one correspondence; and connecting the stair slab LTB to the stair step by a fastener at a position at which the handrail is not disposed.

* * * * *